US006835343B2

(12) United States Patent
Manthei et al.

(10) Patent No.: US 6,835,343 B2
(45) Date of Patent: Dec. 28, 2004

(54) METHOD FOR HANDLING CONCRETE RETAINING WALL BLOCKS

(75) Inventors: Benjamin R. Manthei, Petoskey, MI (US); James A. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 466 days.

(21) Appl. No.: 09/946,991

(22) Filed: Sep. 4, 2001

(65) Prior Publication Data

US 2002/0030303 A1 Mar. 14, 2002

Related U.S. Application Data

(60) Provisional application No. 60/232,701, filed on Sep. 15, 2000, and provisional application No. 60/232,526, filed on Sep. 14, 2000.

(51) Int. Cl.[7] ..... B28B 23/00; B28B 1/14; B28B 7/22; B28B 13/06

(52) U.S. Cl. ..... 264/271.1; 264/274; 264/275; 264/279; 264/333; 264/334; 249/85; 249/97; 249/142; 249/172; 52/125.4; 52/125.6; 414/607; 414/785

(58) Field of Search ..... 264/333, 271.1, 264/274–275, 279, 334; 249/85, 97, 142, 172; 52/125.4, 125.6; 414/607, 785

(56) References Cited

U.S. PATENT DOCUMENTS

| | | | | | |
|---|---|---|---|---|---|
| 776,137 | A | * | 11/1904 | Jackson | 425/195 |
| 985,353 | A | * | 2/1911 | Landis | 249/140 |
| 1,581,797 | A | * | 4/1926 | Fey | 249/172 |
| 2,990,074 | A | * | 6/1961 | Berquist et al. | 414/607 |
| 3,396,862 | A | * | 8/1968 | Fischer | 414/607 |
| 3,464,211 | A | * | 9/1969 | Andresen | 405/262 |
| 3,498,485 | A | * | 3/1970 | Godbersen | 414/697 |
| 3,850,322 | A | * | 11/1974 | Miles et al. | 414/607 |
| 4,992,005 | A | | 2/1991 | Hilfiker | 405/284 |
| 5,402,609 | A | * | 4/1995 | Kelley, Jr. | 52/98 |
| 5,435,949 | A | * | 7/1995 | Hwang | 264/51 |
| 5,651,642 | A | | 7/1997 | Kelley, Jr. et al. | 405/286 |
| 5,817,248 | A | * | 10/1998 | Forlini | 249/68 |
| 6,557,818 | B2 | | 5/2003 | Manthei | 249/171 |
| 6,620,364 | B2 | * | 9/2003 | Gresser et al. | 264/219 |
| 2003/0213656 | A1 | * | 11/2003 | Buzzoni | 188/4 R |
| 2003/0215318 | A1 | * | 11/2003 | Buzzoni | 414/607 |
| 2004/0026601 | A1 | * | 2/2004 | Hamilton et al. | 249/175 |

FOREIGN PATENT DOCUMENTS

| | | | | |
|---|---|---|---|---|
| JP | 10-036063 | A * | 2/1998 | B66C/1/54 |

OTHER PUBLICATIONS

Machine translation of JP 10–036063 A, 2004, Japanese Patent Office website.*

* cited by examiner

*Primary Examiner*—Leo B. Tentoni
*Assistant Examiner*—Michael I. Poe
(74) *Attorney, Agent, or Firm*—MacMillan, Sobanski & Todd, LLC

(57) ABSTRACT

A method and apparatus for handling large concrete retaining wall blocks and the like. The blocks are cast in a form with the front face down, a lifting loop extending from a rear face and with grooves extending in sides from a rear face to adjacent the front face. A spear hook is secured to one of two fork lift tines to extend to one side of the tine away from the other tine. The spear hook engages the lifting loop on the block for lifting the block from the form and for rolling the block into an upright position. The fork lift tines then engage the side grooves from the rear of the block for lifting and moving the blocks and for stacking the blocks to construct a retaining wall.

6 Claims, 6 Drawing Sheets

METHOD FOR HANDLING CONCRETE RETAINING WALL BLOCKS

CROSS-REFERENCE TO RELATED APPLICATIONS

Applicants claim priority to U.S. Provisional Patent Application Ser. Nos. 60/232,526 filed Sep. 14, 2000 and 60,232,701 filed Sep. 15, 2000.

STATEMENT REGARDING FEDERALLY SPONSORED RESEARCH OR DEVELOPMENT

Not Applicable.

TECHNICAL FIELD

The invention relates to concrete retaining wall blocks and more particularly to a method and apparatus for handling concrete retaining wall blocks.

BACKGROUND OF THE INVENTION

Retaining walls have been constructed from precast concrete blocks. The blocks are sometimes cast in a form having four sides and a bottom. The top of the form is open for pouring concrete into the form. Sometimes a heavy wire loop formed, for example, from a bent piece of rebar, is embedded into the block. The wire loop extends from the block to facilitate lifting the block from the form, transporting the block, and stacking the blocks to construct a retaining wall. Alternately, the wire loop may be located in a recess in the block surface so that it does not interfere with stacking the blocks. One common method for moving the blocks is to pass a chain through the wire loop and over a tine on a fork lift. Either the fork lift operator has to get off of the fork lift to attach the chain, or a second worker is needed to attach the chain.

In some cases, retaining wall blocks are cast in a form with the front or face of the block down, so that the wire loop extends from the back of the block. The wire loop is useful for lifting the block from a form in which it was cast. However, a wire loop must be located on the top of and near the center of the block in order to lift the block in a horizontal orientation for stacking when constructing a wall. Sometimes blocks have been formed with a first wire loop extending from the back of the block for lifting the block from the form in which it was cast, and with a second wire loop in a recess in the top surface of the block for use in stacking the block. After the block is lifted from the form, it is turned so that the bottom of the block is down and the chain is moved to the wire loop in the top of the block for lifting the block onto a truck for transportation and for stacking the block to form a retaining wall. This may require a forklift driver to dismount the forklift at least twice in attaching a chain to the two different wire loops, or it may require the use of a second worker for attaching, moving and detaching the chain.

BRIEF SUMMARY OF THE INVENTION

The invention is directed to a method and apparatus for handling large concrete retaining wall blocks and similar heavy cast concrete articles. The blocks may weight, for example, between 500 and 3,000 pounds, or more, depending on their size and configuration. The blocks are cast in a form with a front side or face of the blocks down. The bottom of the form may include a textured insert for imparting a desired texture and pattern on the front surface of the block. The sides of the form define a top, a bottom, a left side and a right side of the cast block. The rear side of the block is formed at an open top of the form. When the block is cast, ends of a heavy wire loop are inserted into the uncured concrete to extend from the rear side of the block near its center. Once a cast block has sufficiently cured to be handled without risk of breaking, the sides of the form are separated from the sides, top and bottom of the block.

According to one aspect of the invention, a spear hook is secured to one tine of a fork lift. The spear hook is angled to a side of the tine so as to not interfere with use of the tine for lifting. The fork lift is manipulated to engage the wire loop extending from the rear side of the block with a hooked end of the spear hook, and the block is lifter clear of the form. The block may then be placed in a temporary storage area or on a truck for transportation. Preferably, the block is set down on its face and the fork lift is manipulated to rotate the block so that its bottom is down. The spear hook is then manipulated to disengage the wire loop.

According to a second aspect of the invention, fork lift grooves are formed in the left and right sides of the cast block to extend substantially parallel to the top and bottom of the block and to extend from the rear side of the block to a location short of the front face of the block. Consequently, when the blocks are stacked to form a retaining wall, the fork lift grooves are not visible. After the block is oriented with its bottom down, the fork lift can approach the block from its rear side, engage the fork lift grooves and lift the block. The fork lift grooves can be used both for lifting the blocks onto and off of a truck for transportation and for stacking the blocks to form a retaining wall. Thus, with the apparatus and method of the invention, a fork lift driver can handle the blocks without the need to get off the fork lift for attaching and detaching a chain to the blocks, and without the need for an additional worker to attach and detach chains.

Accordingly, it is an object of the invention to provide a method and apparatus for handling concrete retaining wall blocks and similar large concrete products.

Other objects and advantages of the invention will become apparent from the following detailed description of the invention and the accompanying drawings.

DETAILED DESCRIPTION OF THE INVENTION

The invention is directed to a method and apparatus for handling large concrete retaining wall blocks. The method involves the use of a conventional fork lift for lifting the blocks from forms in which they are cast, for placing the blocks on a truck for transportation to a work site, and for stacking the blocks to form a retaining wall.

Figure 1:
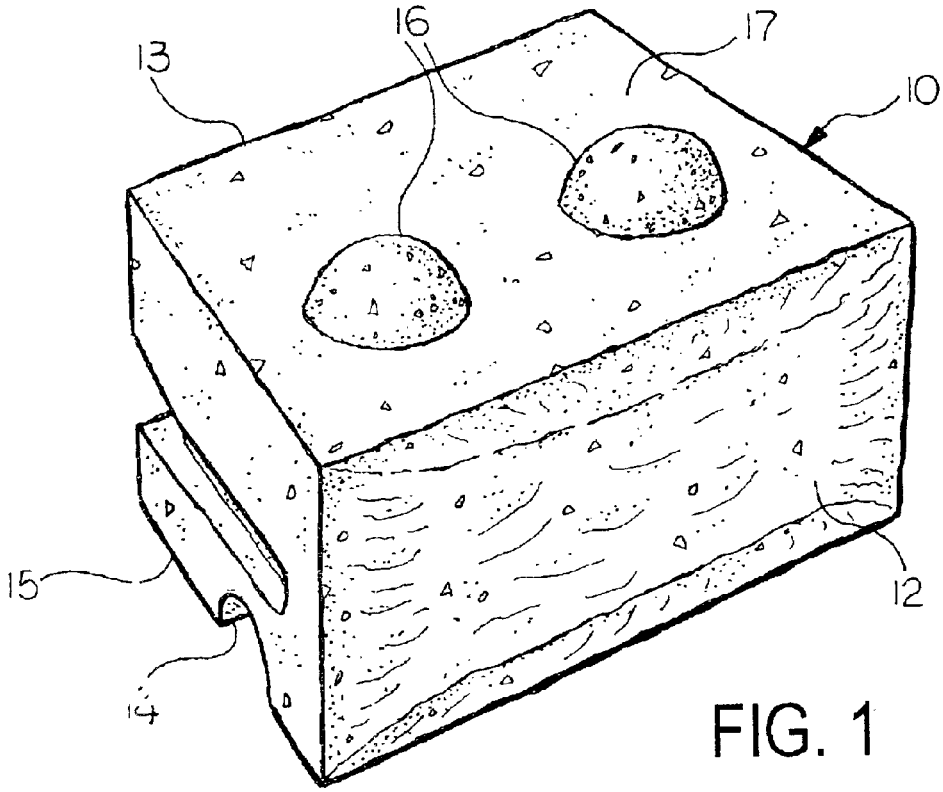
FIG. 1 is a perspective view from the upper front and left sides of one design of a retaining wall block.
Figure 2:
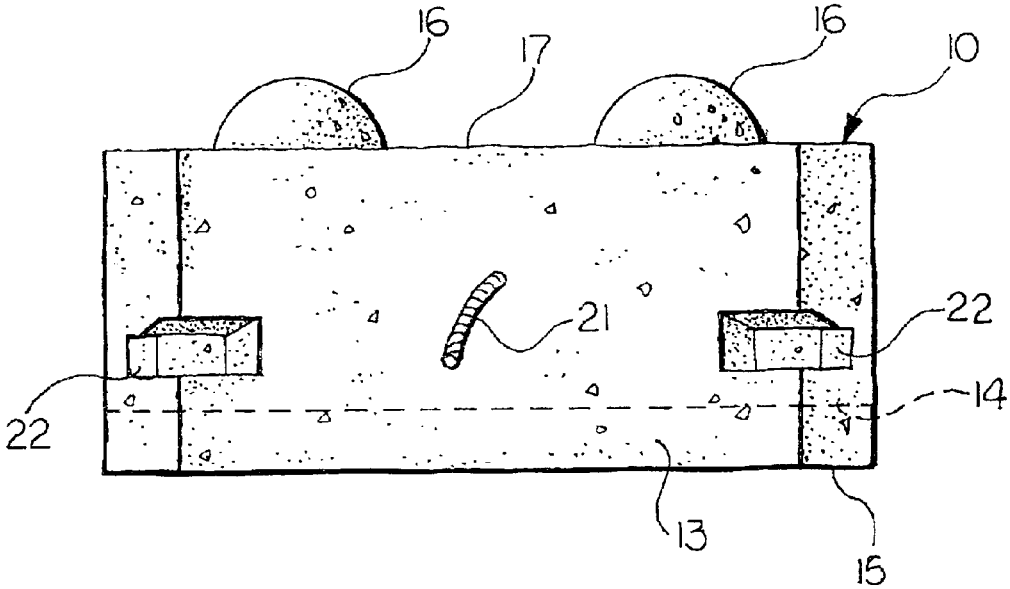
FIG. 2 is a rear elevational of the retaining wall block of FIG. 1.
Figure 3:
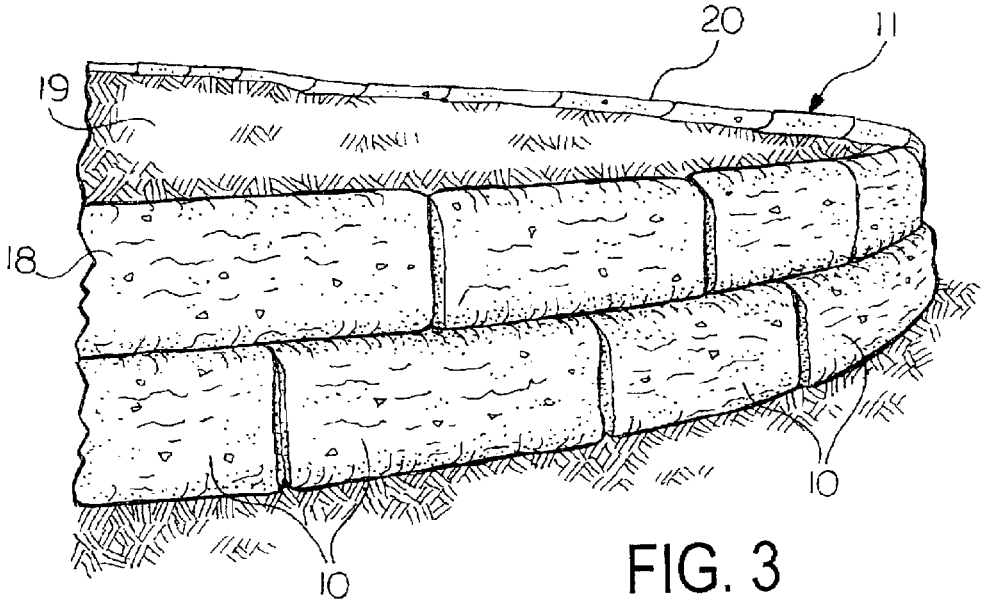
FIG. 3 is a fragmentary perspective view of a two tier landscape retaining wall constructed with the block of FIGS. 1 and 2.

FIGS. 1 and 2 show an exemplary retaining wall block 10, and FIG. 3 shows a two tier wall 11 formed from a plurality of the blocks 10. The wall 11 may be formed from only a single tier of blocks or may be formed from two or more tiers of blocks to provide a desired height. The retaining wall blocks are provided with a generally rectangular front face 12 which may be textured and may be colored to imitate local rock formations. For example, the front face of the concrete blocks 10 may imitate limestone, split limestone or Arizona adobe. The blocks are either trapezoidal or rectangular in plan view. When trapezoidal, the longer parallel side forms the front face 12 of the block 10 which will be visible when the block is placed in a retaining wall and the shorter parallel side 13 forms a rear side of the block 10. This permits forming a curved retaining wall while keeping the front faces 12 of adjacent blocks 10 abutting. The illustrated block 10 has a face which is about 4 feet wide and 1.5 feet high. The depth of the block may vary from as small as about 2 feet to about 4 feet. The finished block may weigh, for example, between about 500 pounds to as much as 3000 pounds, or more, depending on their size and configuration.

In the block 10 illustrated in FIGS. 1 and 2, a semi circular groove 14 extends across the width of the bottom 15 of the block 10 parallel to and spaced behind the front face 12. Two knobs 16 project above a top 17 of the block 10. When blocks 10 are stacked, each knob 16 on the top 17 of the block 10 is received by the groove 14 in the bottom 15 of an adjacent upper block 10 to prevent movement between the blocks. The spacing of the groove 14 and of the knobs 16 from the front face 12 may be selected to establish either a vertical face or a sloping face for the finished wall. The knobs 16 may be omitted from the top of the blocks in the uppermost tier 18 on the wall 11 and the top surface 17 may be recessed below the front face 12 to receive top soil 19 so that grass or other plants may be planted adjacent the front face 12. The front face 12 then forms a lip 20 which retains the top soil 19 above the wall 11. Optionally, the bottom groove 14 may be omitted from the blocks at the bottom of the retaining wall.

As shown in FIG. 2, a lifting loop 21 is embedded in the block 10 to project from near the center of the rear face 13 of the block 10. The lifting loop 21 may be, for example, a bent section of rebar, or of other available material. Also, grooves 22 are formed in the sides of the block to receive the tines of a fork lift for lifting, moving and stacking the blocks, as is described in greater detail below.

Figure 4:
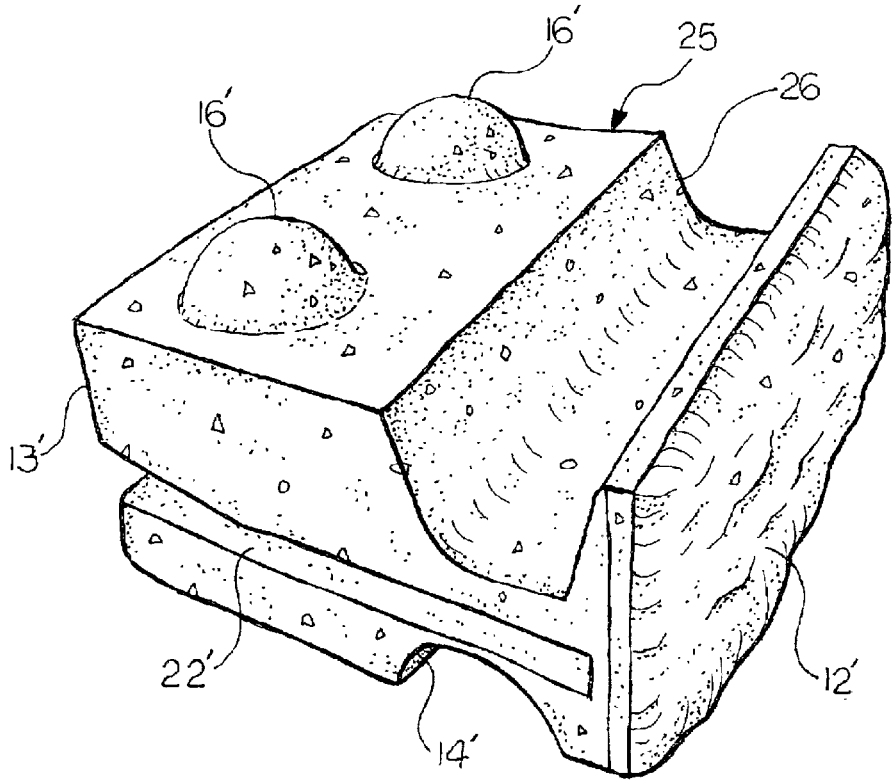
FIG. 4 is a perspective view from the upper left and front sides of a modified retaining wall block.
Figure 5:
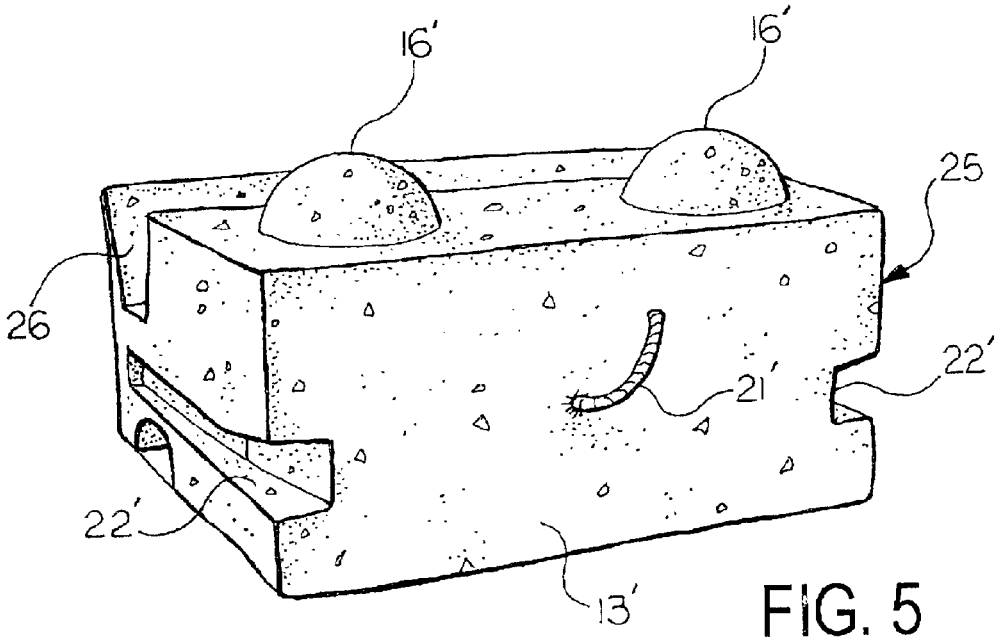
FIG. 5 is a perspective view from the upper rear and right sides of the retaining wall block of FIG. 4.
Figure 6:
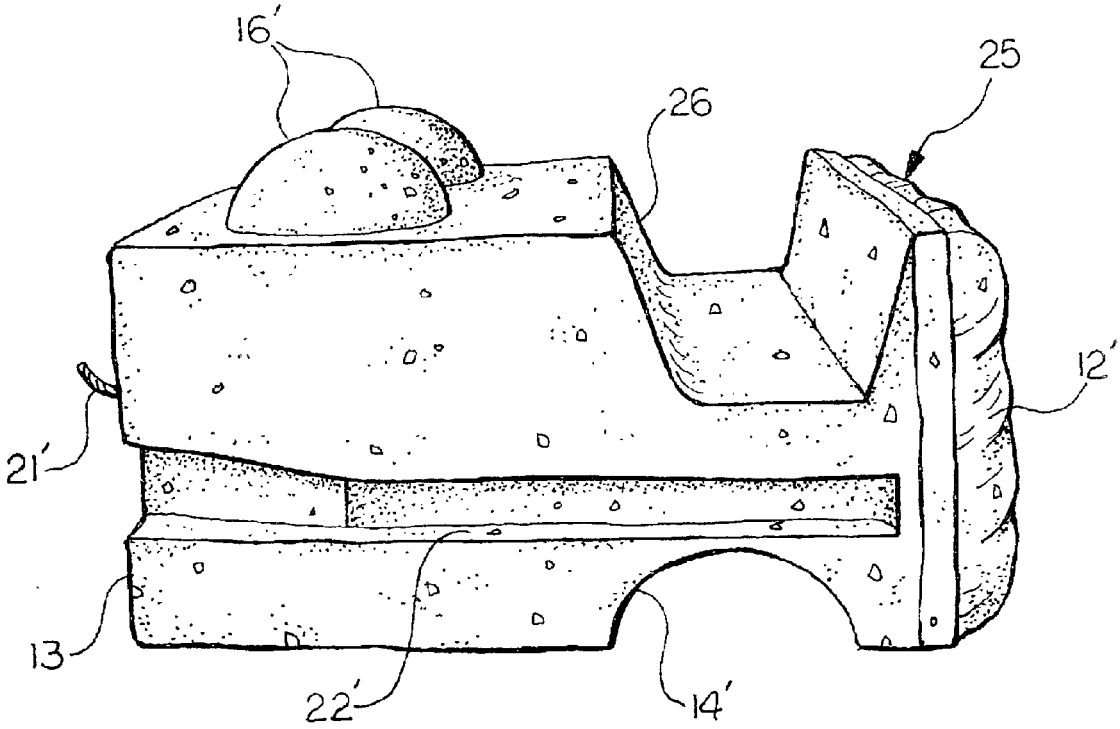
FIG. 6 is a perspective view from the upper left side of the retaining wall block of FIG. 4 and showing details of the slot or groove for receiving a fork lift tine.

FIGS. 4–6 show a planter block 25 for holding plants at an intermediate location on a retaining wall. The knobs 16' are moved towards the rear 13' of the block 25 and a trough 26 is formed in the top 17' adjacent the front face 12' of the block 25. By moving the knobs 16' towards the rear of the block 25, the face of an adjacent upper tier of blocks 10 or 25 will be stepped behind the front face 12' of the planter block 25 to expose at least a majority of the trough 26. The trough 26 may be filled with top soil and planted, for example, with flowers or with ivy or other vine type plants which will grow over the wall. It will be appreciated that an automatic plant watering system and/or a drain system for preventing accumulation of excessive water also may be located in the trough 26.

Figure 7:
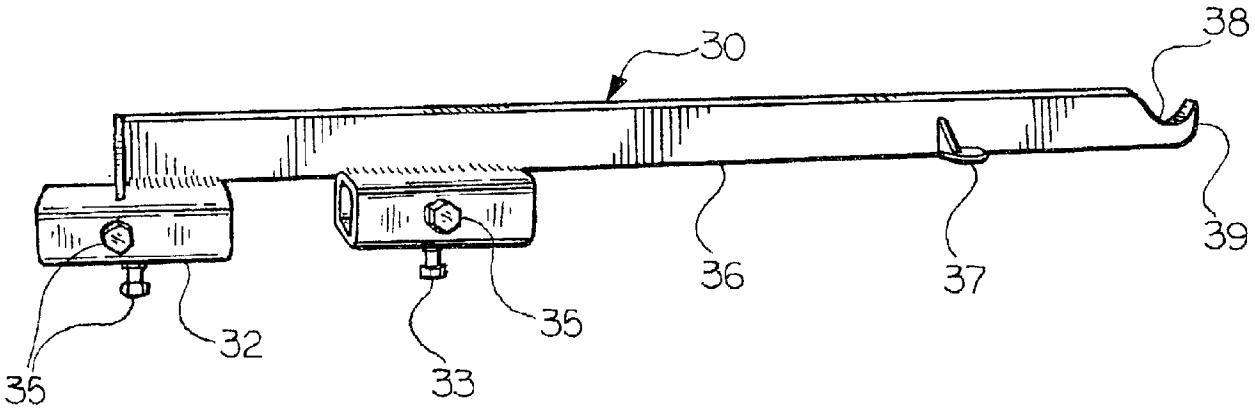
FIG. 7 is a side perspective view of a spear hook which is attached to a fork lift tine for lifting a retaining wall block by an embedded wire loop.
Figure 8:
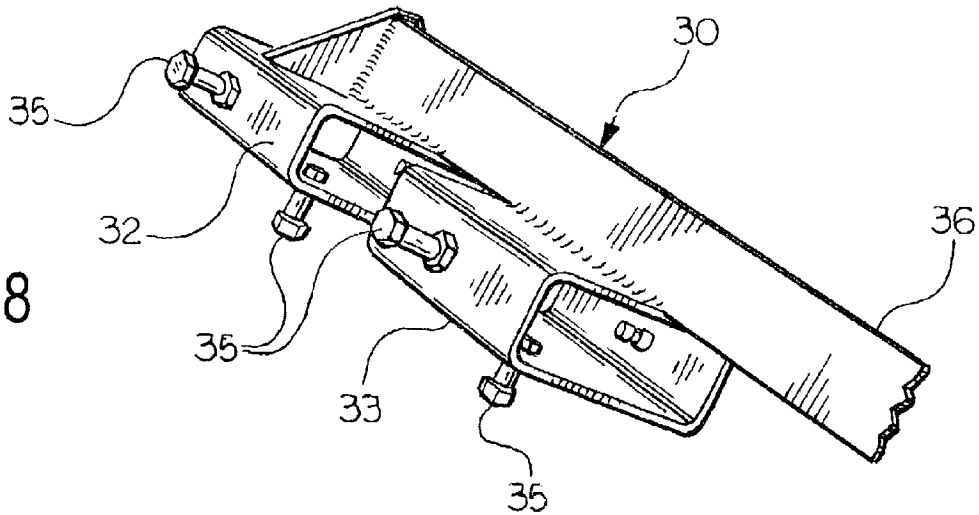
FIG. 8 is a fragmentary enlarged perspective view showing the structure for securing the spear hook to a fork lift tine.
Figure 9:
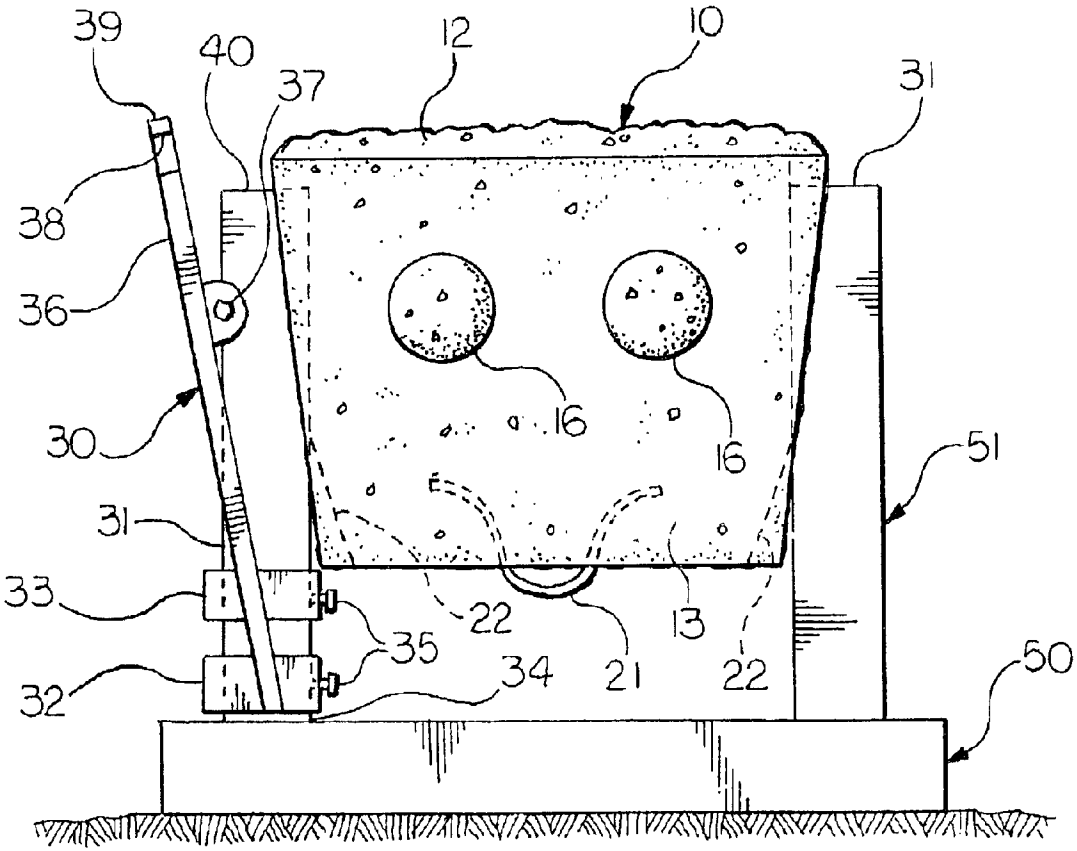
FIG. 9 is a fragmentary top plan view showing the spear hook of FIGS. 7 and 8 attached to a left side tine on a fork lift and showing the fork lift fork engaging the side grooves in a retaining wall block for lifting the block.

FIGS. 7 and 8 show details of a spear hook 30 for attachment to a fork lift tine 31 (FIG. 9) for lifting the blocks 10, 25 by the wire lifting loop 21 which projects from the rear side 13 of the blocks. The spear hook 30 includes two brackets 32, 33 adapted to slide over the fork lift tine 31 to adjacent a rear end 34 (FIG. 9) of the tine 31. Bolts 35 are provided to tightly secure the brackets 32, 33 to the tine 31. A shaft 36 is welded to the brackets at an angle to extend forward towards a free end 40 of the tine 31 and away from the second tine 31'. The illustrated spear hook 30 is arranged for attachment to the tine 31 on the left side of the fork lift (as shown in FIG. 9). However, the shaft 36 may be welded to the brackets 31, 32 to extend to the other side for attachment to the right tine 31'. Preferably, a bracket 37 also is attached further forward on the shaft 36 for attachment to the tine 31 closer to a free end 39 of the shaft 36 to further enhance the rigid connection between the spear hook 30 and the fork lift tine 31. A hook 38 is formed at the free end 39 of the shaft 36 which, preferably, extends a short distance past the free end of the fork lift tine 31. By angling the spear hook 30 slightly away from the tines 31, 31', the spear hook 30 will not interfere with lifting a block 10 positioned between the tines 31, 31'.

It will be appreciated that the illustrated three brackets 32, 33 and 37 for securing the spear hook shaft 36 to a fork lift tine 31 can be replaces with a single bracket such as an elongated tubular sleeve which slides over the tine 31, or with two brackets which are sized to provide the support for the shaft 36 needed to lift heavy blocks 10. By providing a bracket 37 which is spaced some distance forward from one or two brackets 32 and 33, the strength of the connection between the shaft 36 and the tine 31 is significantly increased, permitting lifting heavier weights with the spear hook 30.

FIG. 9 is a fragmentary top plan view showing the fork lift tines 31, 31' with a spear hook 30 attached to the left tine 31, and the tines 31, 31' engaging the grooves 22 in the side of a retaining wall block 10 for lifting and moving the block. As is illustrated, the spear hook 30 is mounted on the tine 31 so that it does not interfere with positioning the tines 31, 31' in the block grooves 22 for picking up the retaining wall block 10. The lifting grooves 22 begin at the rear side 13 of the block 10 and stop short of the front face 12. The block 10 is picked up from its rear so that the grooves are not visible from the exposed faces 12 of the blocks forming the finished retaining wall 11.

Figure 10:
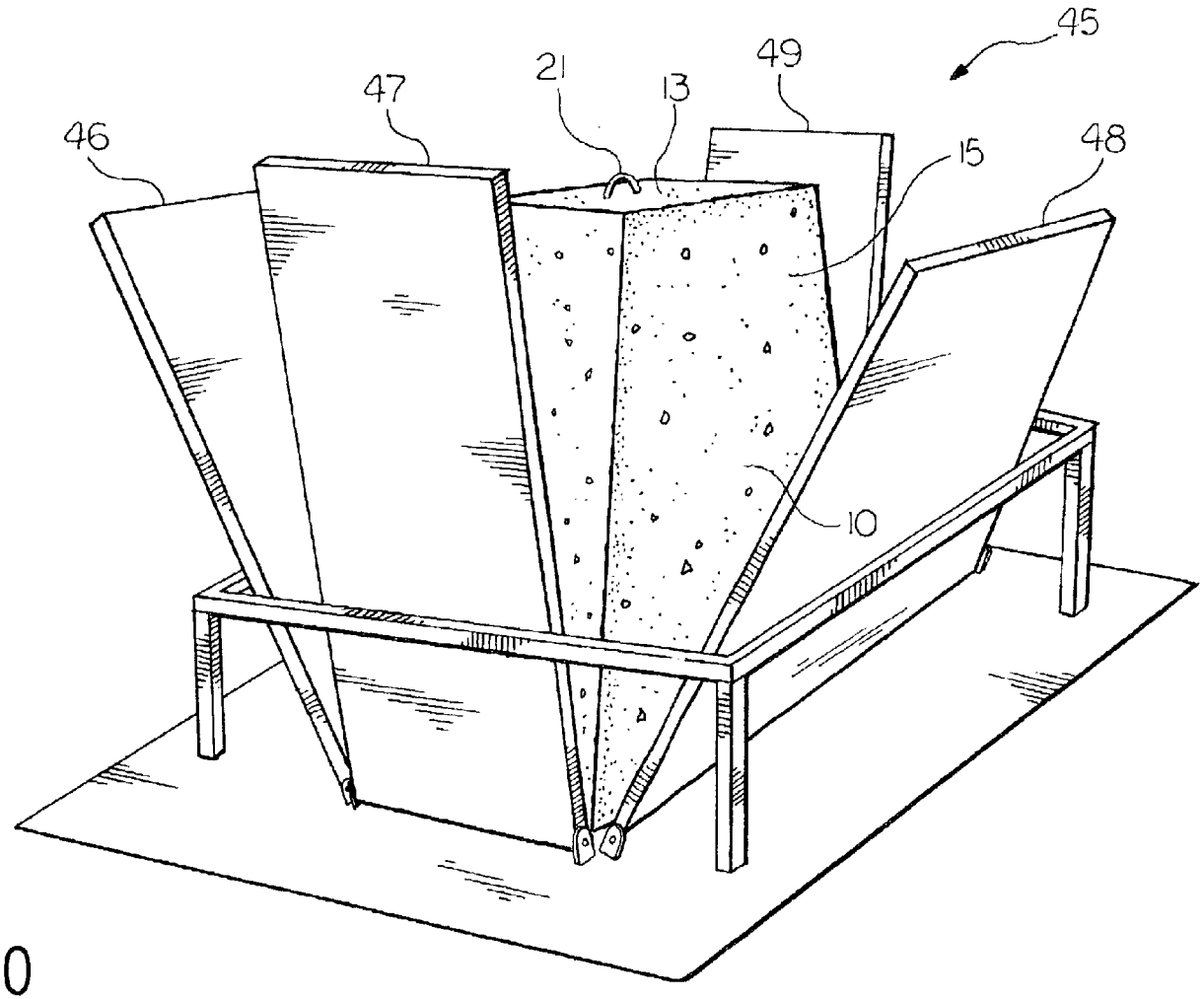
FIG. 10 is a perspective view showing a cast retaining wall block in a form in which the sides have been pivoted away from the block to permit lifting the block from the form.

FIG. 10 shows an exemplary form 45 in which a retaining wall block 10 has been cast. The sides 46–49 of the form are either pivoted away from the cured block 10 (as shown) or otherwise removed from the cured block 10 to open the form 45 for removal of the cured block 10. The illustrated block 10 was cast with its finished front face down and with the rear side 13 of the block 10 up. The embedded wire lifting loop 21 extends above the rear side 13 of the block 10. A fork lift 50 (shown only in fragmentary in FIG. 9) with an attached spear hook 30 is used to lift the block 10 from the open form 45. The fork lift 50 is positioned with the hooked end 38 of the spear hook 30 engaging the lifting loop 21 and the fork 51, which comprises the tines 31, 31', is raised to lift the block 10 clear of the form 45. It should be appreciated that the block 10 may be formed with other types of lifting points for engagement with the spear hook 30 in place of the lifting loop 21.

After the block 10 is lifted clear of the form 45, the fork lift 50 moves the block 10 away from the form 45. The block 10 may then be set on the ground on its front face 12. While the spear hook 30 still engages the lifting loop 21, the fork lift 50 may be moved to roll the block to its upright position with the bottom 15 of the block resting on the ground and the fork lift grooves 22 generally parallel to the ground. The fork lift 50 may then be positioned with the tines 31, 31' engaging the grooves 22 on the sides of the block 10 and the block 10 may be stacked in inventory, or positioned on a truck (not shown) for transporting to a storage area or to a construction site. At the construction site, a fork lift lifts the blocks 10 from the truck and stacks them to form the retaining wall. It should be noted that a single operator may lift the block 10 from the form, stack the blocks 10 in an inventory area, and place the blocks on a truck without the help of another worker and without having to get off of the fork lift to attach a chain between the block 10 and a fork lift tine. In the past, chains were frequently used to attach the blocks to a fork lift tine. A fork lift also may be used for moving and stacking the blocks 10 to form a retaining wall without the need to manually attach each block 10 to the fork lift. Consequently, the labor required for handling the retaining wall blocks 10 is significantly reduced.

It will be appreciated that various modifications and changes may be made to the above described preferred embodiment of a method and apparatus for handling retaining wall blocks and similar heavy cast concrete articles without departing from the scope of the following claims.

What is claimed is:

1. A method for handling retaining wall blocks comprising the steps of:

a) forming a retaining wall block having front, rear, left and right sides, a top and a bottom in a form with said front side down and with a lifting loop embedded in said retaining wall block to extend from said rear side;

b) securing a spear hook to a first of two tines on a fork lift to extend at an acute angle relative to a free end of the first tine and to a side of said first tine away from the second of said tines;

c) engaging said lifting loop with a hook on said spear hook; and d) operating the fork lift to raise said spear hook to lifting said block from said form.

2. A method for handling retaining wall blocks, as set forth in claim 1, and further including the steps of operating the fork lift to set said block down with the bottom down, and disengaging said spear hook from said lifting loop.

3. A method for handling retaining wall blocks, as set forth in claim 2, and after setting said block down and prior to disengaging said spear hook from said lifting loop, further including the step of manipulating said spear hook to position said block with its bottom down.

4. A method for handling retaining wall blocks, as set forth in claim 3, wherein said retaining wall block is formed with a fork lift groove formed in each of said left and right sides to extend from said rear side to a location short of said front side, and further including the step of engaging said fork lift grooves with the tines of a fork lift for lifting and moving said retaining wall block with its bottom down.

5. A method for handling retaining wall blocks comprising the steps of:

a) forming a retaining wall block having a front, rear, left and right sides, a top and a bottom with fork lift grooves formed in said left and right sides to extend from said rear side and to stop short of said front side and with a lifting loop embedded in said retaining wall block to extend from said rear side wherein said retaining wall block is formed in a form with said front side down;

b) lifting said retaining wall block from said form using said lifting loop;

c) setting said retaining wall block down with said bottom down prior to engaging said fork lift grooves with the tines of a fork lift; and d) engaging said fork lift grooves with the tines of a fork lift for lifting and moving said formed retaining wall block.

6. A method for handling retaining wall blocks comprising the steps of:

a) forming a retaining wall block having front, rear, left and right sides, a top and a bottom with fork lift grooves formed in said left and right sides to extend from said rear side and to stop short of said front side;

b) engaging said fork lift grooves with the tines of a fork lift for lifting and moving said formed retaining wall block;

wherein said retaining wall block is formed in a form with said front side down and with a lifting loop embedded in said retaining wall block to extend from said rear side, and further including the steps of lifting said retaining wall block from said form using said lifting loop, and setting said retaining wall block down with said bottom down prior to engaging said grooves with the tines of a fork lift; and wherein the fork lift has first and second generally parallel tines each having a free end, and further including the step of securing a spear hook to the first tine to extend at an acute angle relative to the free end of said first tine and to a side of said first tine away from the second tine, and wherein said retaining wall block is lifted from said form by engaging said lifting loop with a hook on said spear hook and operating the fork lift to raise said spear hook.

* * * * *